United States Patent [19]

Koski

[11] 4,366,752

[45] Jan. 4, 1983

[54] ON-MACHINE SUPERCALENDER APPARATUS FOR PAPER OR THE LIKE

[75] Inventor: Erkki Koski, Jyväskylä, Finland

[73] Assignee: Valmet Oy, Finland

[21] Appl. No.: 266,107

[22] Filed: May 21, 1981

[30] Foreign Application Priority Data

May 22, 1980 [FI] Finland ..... 801665

[51] Int. Cl.[3] ..... B30B 3/04

[52] U.S. Cl. ..... 100/162 R; 100/168; 100/170

[58] Field of Search ..... 100/155, 161, 162 R, 100/163 A, 163 R, 165, 168, 169, 170, 35; 162/361, 362

[56] References Cited

U.S. PATENT DOCUMENTS 3,905,288 9/1975 Holm ..... 100/162 R 4,128,053 12/1978 Kankaanpaa ..... 100/162 R

*Primary Examiner*—Peter Feldman

*Attorney, Agent, or Firm*—Steinberg & Raskin

[57] ABSTRACT

Calender apparatus for paper or the like adapted to be directly associated with a paper machine and to operate as an on-machine supercalender includes a plurality of hard calendering rolls arranged over one another so as to form a stack of hard rolls and a plurality of soft calendering rolls adapted to define a series of soft supercalender nips with the hard rolls. The hard and soft rolls are mounted on drivable support apparatus whereby the hard nips defined by the hard rolls can be opened and the soft supercalendering nips closed in order to accomplish supercalendering operation on a web passing through the apparatus.

4 Claims, 4 Drawing Figures

ON-MACHINE SUPERCALENDER APPARATUS FOR PAPER OR THE LIKE

BACKGROUND OF THE INVENTION

The present invention relates generally to apparatus for treating paper webs or the like and, more particularly, to calender apparatus for paper or the like adapted to be directly associated with a paper machine and to operate as an on-machine supercalender.

Still further, the present invention relates to calender apparatus for paper or the like adapted to operate as a so-called on-machine supercalender and which comprises a plurality of hard calendering rolls arranged one over the other so as to form a stack of rolls, and a plurality of soft rolls which can be arranged to form, together with the hard rolls, soft supercalender nips. Both the hard and soft rolls are suspended by means of supporting equipment provided with drive units such that in order to accomplish a supercalendering operation, the hard nips defined between the hard rolls can be opened while the soft supercalender nips closed.

The calendering of a paper web leaving the discharge end of a paper machine is a well known final finishing treatment for determining the smoothness and gloss of the surfaces of the paper as well as its consistency. Such calendering is generally accomplished by guiding a continuous paper web successively through a series of nips formed by calendering rolls.

Conventionally, a paper web is calendered in a so-called stack (machine-finishing stack) situated immediately adjacent to the output side of the paper machine and, when required, the treatment is accomplished in a so-called supercalender.

Calender apparatus comprise calendering rolls which define calendering nips through which the web is passed. Such calendering rolls constitute either "hard" rolls or "soft" rolls. It is understood that as used herein, the term hard rolls designates rolls formed, for example, of chill casting or steel, the hard surfaces of which have been ground smooth. The term soft rolls as used herein designates rolls whose surfaces are made of flexible material. For example, a flexible material generally used for such soft rolls is paper wrapped in layers around the shaft of the roll and compressed to form a uniform roll coating.

Furthermore, as used herein, the term "soft nip" designates the contact line between a soft roll and hard roll. The term "hard nip" is used to designate the contact line formed between two hard rolls.

It is possible depending upon the type of paper and the requirements therefor to machine finish the paper web in a single nip calender, i.e., a calender comprising only one pair of rolls. In most cases, however, a calender stack will comprise between four and eight rolls forming three to seven nips. In fact, in separate calender stacks for machine-finishing there can be as many as ten pairs of nips.

It is usually an object to machine finish paper so that both sides of the paper have an equal gloss. Accordingly, at least two soft nips are generally provided located in a manner such that both surfaces of the paper web are pressed against the surface of a hard roll.

In connection with improving the efficiency of paper production, it has proven important to provide a calender unit in which both the functions of a machine-finishing unit as well as a supercalender are combined. In this connection, applicant's Finnish patent application No. 761764 discloses an on-machine supercalender apparatus adapted to be incorporated in a paper machine. Such supercalender comprises a roll stack including conventional hard rolls and essentially the same number of soft rolls which are located outside of the roll stack to form soft nips against the hard rolls.

In such a calender unit which constitutes a combination of a machine-finishing stack and a supercalender, the paper web can be supercalendered as desired immediately after the same leaves the paper machine without any intermediate phases. However, the results obtained are not entirely satisfactory in that the so-called super gloss effected by the calendering treatment is not uniform. In other words, some areas of the surface of the paper are glossier than other areas. Furthermore, it has been found that the paper web subjected to the calendering treatment turns a blackish color resulting at least partially from the fact that the hard nips are in fact too hard and unduly inflexible.

SUMMARY OF THE INVENTION

It is an object of the invention to provide new and improved calender apparatus wherein in addition to the apparatus being capable of functioning as an on-machine supercalender, the same may also function as a conventional machine-finishing stack having hard nips when the need arises.

Another object of the present invention is to provide new and improved calender apparatus wherein the stack rolls, such as paper rolls, which tend to be easily damaged can be replaced in a rapid manner and such that the web is not broken during roll replacement.

Still another object of the present invention is to provide new and improved calender apparatus wherein the end of the web is easily threaded through the nips.

A further object of the present invention is to provide new and improved calender apparatus wherein open web draws are provided between the soft supercalendering nips in a manner such that the width of the web may change between nips due to calibration and changes of volume of the web.

According to the present invention, these and other objects are attained by providing calender apparatus including a plurality of hard calendering rolls located one on top of the other so as to form a stack of rolls, a plurality of soft rolls which can be arranged to form soft supercalender nips with corresponding hard rolls and wherein both the hard and soft rolls are mounted on support apparatus equipped with drive units and which function so that when the apparatus operates as a supercalender, the hard nips defined between the hard rolls are open and the soft supercalender nips closed. In order to allow for quick and easy replacement of the easily damaged soft calender rolls without the possibility of web breakage, the hard and soft rolls are arranged in a manner such that from the viewpoint of the calendering rolls, the web is essentially guided by only the hard rolls as it passes through the calender apparatus.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
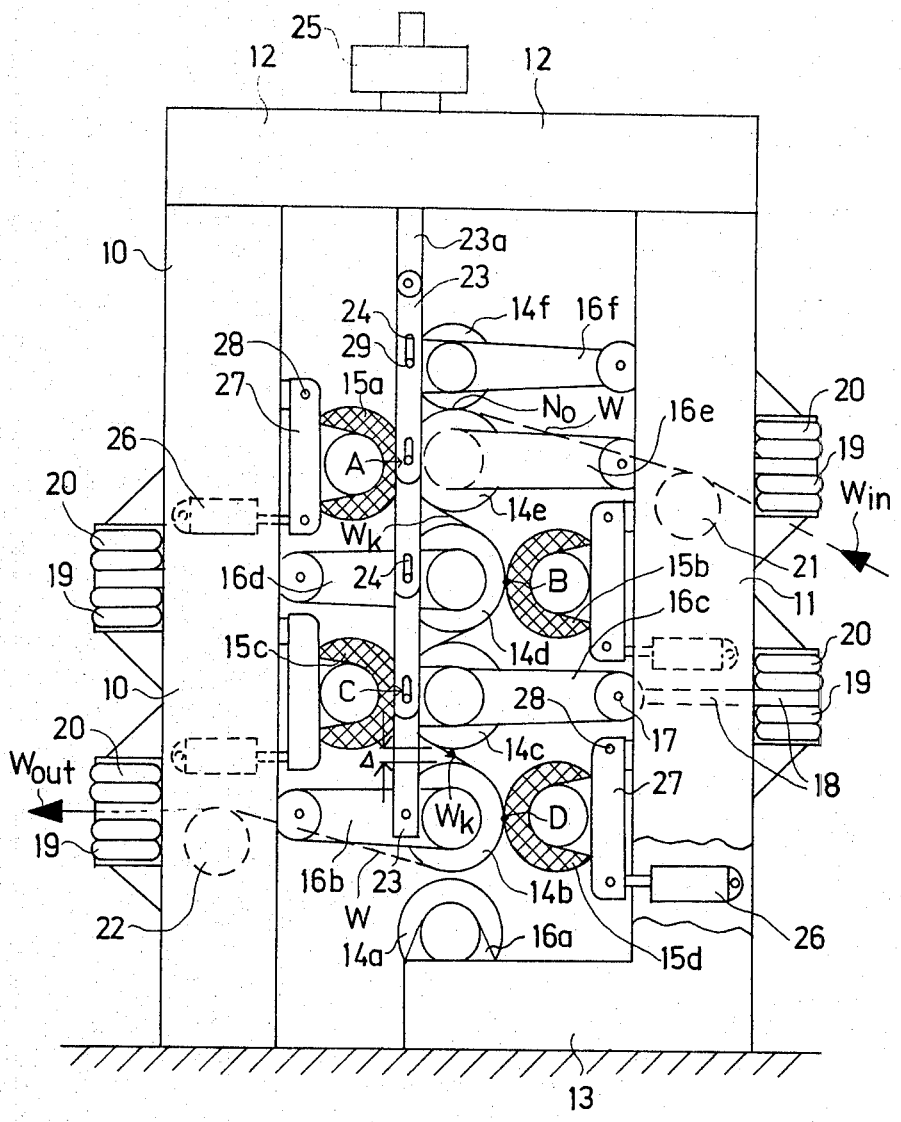
FIG. 1 is a side elevation view of calender apparatus according to the present invention, the apparatus being adjusted so as to function as an on-machine supercalender.

Referring now to the drawings when like reference characters designate identical or corresponding parts throughout the several views, and more particularly to FIG. 1, the calender apparatus includes pairs of spaced frame columns 10 and 11 (only one shown), the spacing between each pair of columns being determined by the length of the calender rolls 14 and 15. A horizontally extending frame member 12 interconnects the tops of the frame columns 10 and 11. An inner, horizontally extending frame member 13 is associated with the frame column 11.

The calender apparatus comprise a calender stack composed of a plurality of hard calender rolls 14*a*, 14*b*, 14*c*, 14*d*, 14*e*, and 14*f*. The surfaces of rolls 14 are smooth and glossy being constructed, for example, of chill casting or steel. In the illustrated embodiment, the hard calender rolls 14 are arranged one over the other in a vertical stack so that their respective axes of rotation substantially lie in the same vertical plane. However, it is understood that in certain applications, the calender rolls 14 can be laterally offset with respect to each other.

The lowest calender roll 14*a* is rotatably mounted about a fixed axis to frame member 13 by fixed bearing supports 16*a*. However, the other hard calender rolls 14*b*–14*f* are adjustably suspended from frame columns 10 and 11 by means of double-arm lever pairs 16*b*–16*f*, respectively. As seen in FIG. 1, the suspension arm pairs 16 are connected to arms 18 by cardan shafts 17 in a manner such that the position of each calender roll 14 can be adjusted in a substantially vertical direction by means of a bellows device 19 and 20. In this manner, the hard calender nips defined by adjacent pairs of hard calender rolls and designated $N_0$, $N_1$, $N_2$, $N_3$, $N_4$ and $N_5$ throughout the several figures, can be loaded with any suitable linear pressure as desired.

A plurality of soft calender rolls 15*a*, 15*b*, 15*c* and 15*d*, which may constitute paper-coated supercalender rolls known per se, are associated with the intermediate hard calender rolls 14*b*, 14*c*, 14*d* and 14*e*. More particularly, the soft calender rolls 15 are mounted on supporting apparatus 27 which are adapted to be driven such that one or more soft rolls can be moved into position to form soft supercalender nips A, B, C and D and also to adjust the linear pressure of the soft supercalender nips as desired.

At each side of the calender apparatus, a respective one of each of the supporting arm pairs 16 is connected to a link arm 23 by a pin 29 which extends through a longitudinal slot 24. An arm 23*a* connects the link arms 23 to a helical gear 25 so that in this manner, the link arms 23 can be lifted by helical gear 25 so that the hard calender rolls obtain the position illustrated in FIGS. 1 and 2 in which there is a certain spacing Δ between the intermediate rolls 14.

An important feature of the calender apparatus as described above is that in its main functional modes, the web W is guided only by hard rolls 14 and, possibly, by guide rolls 21 and 22 as it passes through the calender. In particular, the soft rolls 15 do not participate in the guidance of web W. Rather, the soft rolls 15 only form soft nips A–D and do not serve to guide the web W, the latter being guided over the surface of respective hard rolls 14.

An essential feature of the present invention is that the soft calendering nips A, B, C and D are formed by separate roll pairs, each roll pair being constituted by a soft roll 15 and a respective hard roll 14. More particularly, a single soft roll 15 is associated with each of the intermediate hard rolls 14*b*, 14*c*, 14*d* and 14*e* and, therefore, only a single soft nip is formed at each hard roll. By virtue of the fact that as the web W passes through the calender apparatus, as between the calender rolls, only the hard rolls 14 serve to guide the run of the web W, a practical advantage is obtained that the easily damaged soft rolls can be replaced without the possibility of breaking web W during the replacement operation.

It is also noted that in the illustrated embodiment, the additional important advantage is obtained that each side of web W alternately comes into contact with a soft roll 15.

The operation of the calender apparatus of the present invention in various situations will now be described.

Figure 2:
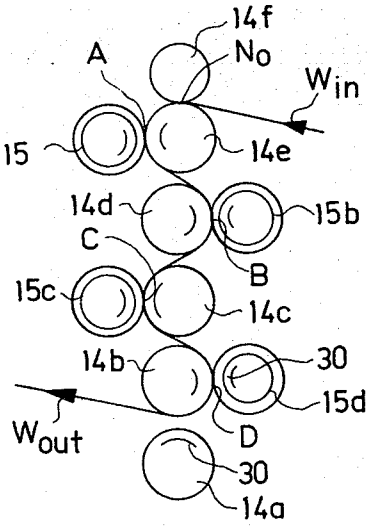
FIG. 2 is a schematic view of calender apparatus as illustrated in FIG. 1, i.e., with the apparatus functioning as an on-machine supercalender, various frame components being omitted for clarity.

Referring to FIGS. 1 and 2, the supercalender nips A, B, C and D are closed and the calender apparatus functions as an on-machine supercalender. When required, the uppermost hard roll 14*f* and the next highest hard roll 14*e* form between them a hard smoothing nip $N_0$. In FIGS. 1 and 2, the web entering the calender apparatus is designated $W_{in}$ and the web exiting from the calender apparatus is designated $W_{out}$. The web has free runs $W_k$ between the intermediate hard calender rolls so that the web may be spread between the nips A, B, C and D of the supercalender. The linear pressure at soft calendering nips A, B, C and D is suitably adjusted by means of pairs of cylinders 26 associated with supporting apparatus 27. More particularly, supporting equipment 27 is pivotally attached by shaft 28 and the piston cylinder arrangements 26 are adapted to pivot the supporting equipment 27 as is clear from FIG. 1. The link arms 23 and associated structure 23*a*, 24, 29 and helical screw 25 operate to raise the hard rolls 14 to a position such that a vertical opening Δ is defined between them. The web $W_{in}$, guided by the guide roll 21, passes through smoothing nip $N_0$ from where it passes through supercalendering nips A, B, C and D and leaves the calender apparatus at $W_{out}$ guided by guide roll 22.

Figure 3:
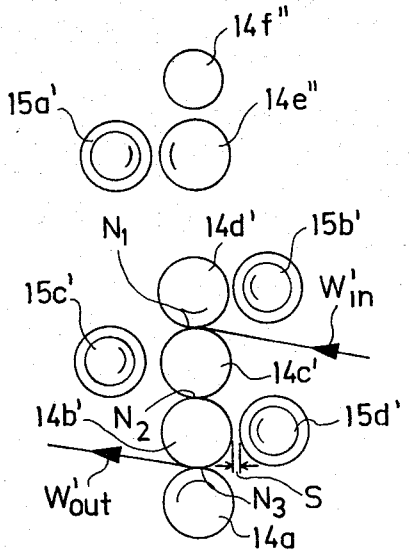
FIG. 3 is a schematic illustration of calender apparatus according to the present invention wherein the calender rolls are positioned such that the soft nips are open and the three lowermost hard nips closed so that the apparatus functions as a machine-finishing stack.

Referring to FIG. 3, the positions of the calender rolls are adjusted in the manner described above so that the calender apparatus is arranged to function as a 3-nip machine-finishing stack with hard nips $N_1$, $N_2$, $N_3$ with the web entering the apparatus designated $W'_{in}$ and the web leaving the apparatus being designated $W'_{out}$. In this arrangement, the soft calender rolls 15*a'*, 15*b'*, 15*c'* and 15*d'* are laterally displaced by means of the drive units 26 pivoting the support equipment 27 so that a definite lateral spacing S is defined between each soft roll 15 and a corresponding hard roll 14. The hard nips $N_1$, $N_2$ and $N_3$ are loaded to the desired level by means of apparatus 18, 19 and 20. Thus, neither the soft rolls nor the hard rolls 14*e''* and 14*f''* participate in the calendering operation. It will be understood that in order to create the particular functional arrangement of the apparatus illustrated in FIG. 3, slight modifications must be made in equipment 23, 23*a*, 24 and 29 from that illustrated in FIG. 1 which are well within the skill of the art.

Figure 4:
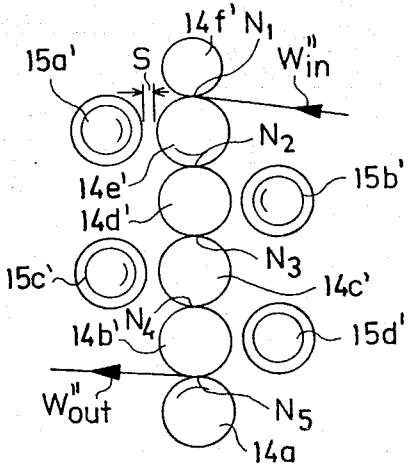
FIG. 4 is a schematic elevation view of calender apparatus according to the present invention wherein all of the soft nips are open and all of the five hard nips closed and illustrating the use of the apparatus either as a five nip machine-finishing stack or during the time when the web is being initially threaded through the apparatus which will function as an on-machine supercalender.

Referring now to FIG. 4 wherein the rolls of the calender apparatus of the present invention have again been relocated relative to the embodiments illustrated in FIGS. 1, 2 and 3 so that the calender apparatus can function as described below. Thus, all of the hard rolls 14 are in nip defining relationship with each other so as to define hard nips $N_1$, $N_2$, $N_3$, $N_4$ and $N_5$ and the soft rolls 15*a'*–15*d'* have been laterally displaced a distance S from corresponding hard rolls so that the supercalendering nips A, B, C and D are all open. The web $W''_{in}$ enters the apparatus passing through hard nip $N_1$ and leaves the apparatus at $W''_{out}$ from nip $N_5$ and after the same has passed through the previous hard press nips.

The functional mode of the calender apparatus illustrated in FIG. 4 wherein hard nips N are formed and soft nips are open is adapted to operate as a machine-finishing stack. This arrangement is also beneficially utilized during the start up phase of the supercalender, i.e., in the threading of the web W through the apparatus. In this case, the hard nips N are closed but, preferably, with no significant linear nip pressure existing in these nips. More particularly, the linear pressure is adjusted only so as to be able to grip the end transfer tape of the web and direct it through the nips and so as to efficiently result in a suitable spreading of the web W. After the threading operation, the hard nips N are opened and the soft nips A–D closed so that the calender apparatus obtains the functional configuration illustrated in FIGS. 1 and 2 wherein the calender apparatus operates in its principal mode, namely as on-machine supercalender having soft nips A, B, C and D.

The above description emphasizes yet another advantage of the present invention, namely that the calender apparatus of the present invention can function both as an on-machine supercalender and, when required, also function as a conventional machine-finishing stack.

It is clear that certain structural variations of the present invention are possible within the scope of the invention. For example, the calender stack 14*a*–14*f* need not be substantially vertical as shown but can assume either a moderately or even substantially inclined configuration relative to the vertical. Additionally, hard calender rolls 14 can also be offset with respect to each other as is known. Further, the drive and roll support apparatus of both the hard and soft calender rolls 14 and 15 can also substantially differ from the particular structure illustrated in FIG. 1.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Calender apparatus for paper or the like adapted to be directly associated with a paper machine and to operate as an on-machine supercalender, comprising:

a plurality of hard calendering rolls arranged over one another so as to form a stack of rolls and adapted to define a series of hard nips therebetween;

a plurality of soft rolls adapted to define a series of soft supercalender nips with corresponding ones of said hard rolls;

drivable support means mounting said hard and soft rolls for opening at least some of the hard nips defined between said hard rolls and for closing at least some of the soft supercalender nips in order to subject a web passing through the apparatus to a supercalendering operation; and wherein said hard and soft rolls are arranged relative to each other such that as between said rolls, a web passing through said calender apparatus is guided substantially only by said hard rolls, whereby said soft rolls can be replaced without the possibility of web breakage.

2. The combination of claim 1 wherein said stack of hard calendering rolls includes outer rolls and intermediate rolls, and wherein said soft calendering rolls define soft calendering nips with corresponding hard rolls and wherein said soft rolls are substantially situated at alternating opposite ones of the two lateral sides of corresponding adjacent hard rolls, whereby pairs of hard and soft rolls define said soft supercalendering nips.

3. The combination of claim 1 wherein said drivable support means further comprise means for spacing said hard calendering rolls relative to each other by a predetermined distance such that the web has a substantially free run between the soft supercalendering nips as the web moves from a hard roll to the next hard roll in the direction of web travel.

4. The combination of claim 1 wherein said drivable support means comprise means for opening all of said hard nips except the hard nip defined by an uppermost hard calendering roll and the hard roll located immediately beneath said uppermost hard roll even while said soft supercalender nips are closed to form a smoothing nip before the first soft supercalendering nip.

* * * * *